US006973409B1

(12) United States Patent
Shimizu et al.

(10) Patent No.: US 6,973,409 B1
(45) Date of Patent: Dec. 6, 2005

(54) LIQUID CONTAINER, METHOD OF MANUFACTURING THE SAME, AND METHOD AND PROGRAM OF CONTROLLING LIQUID EJECTING DEVICE

(75) Inventors: Yoshiaki Shimizu, Nagano (JP); Takeo Seino, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/445,455

(22) Filed: May 27, 2003

(30) Foreign Application Priority Data

May 27, 2002 (JP) ..... P2002-152949
May 26, 2003 (JP) ..... P2003-148262

(51) Int. Cl.[7] ..... B41J 29/393
(52) U.S. Cl. ..... 702/173; 347/19; 347/36; 347/86; 347/87
(58) Field of Search ..... 702/173; 347/19, 347/36, 86, 87

(56) References Cited

U.S. PATENT DOCUMENTS

| | | | | |
|---|---|---|---|---|
| 5,590,403 | A | 12/1996 | Cameron et al. | |
| 6,224,199 | B1 | 5/2001 | Yamaguchi et al. | |
| 6,289,654 | B1 | 9/2001 | Yamaguchi et al. | |
| 6,431,673 | B1 * | 8/2002 | Heim et al. | 347/9 |
| 6,507,409 | B2 | 1/2003 | Kawaguchi | |
| 2001/0013885 | A1 | 8/2001 | Yamaguchi et al. | |
| 2002/0015066 | A1 * | 2/2002 | Siwinski et al. | 347/19 |
| 2002/0051021 | A1 * | 5/2002 | Mochizuki et al. | 347/7 |
| 2002/0105565 | A1 | 8/2002 | Suda et al. | |
| 2003/0140694 | A1 * | 7/2003 | Usui et al. | 73/290 V |
| 2003/0151648 | A1 | 8/2003 | Suda et al. | |

FOREIGN PATENT DOCUMENTS

| | | | |
|---|---|---|---|
| EP | 1 080 912 | A2 | 3/2001 |
| JP | 09-277508 | | 10/1997 |
| JP | 10-193635 | A | 7/1998 |
| JP | 11-342623 | A | 12/1999 |
| JP | 2001-063027 | A | 3/2001 |
| JP | 2001-071533 | A | 3/2001 |
| JP | 2001-301198 | A | 10/2001 |
| WO | WO-01/92017 | A1 | 12/2001 |

* cited by examiner

*Primary Examiner*—Michael Nghiem
*Assistant Examiner*—Hien Vo
(74) *Attorney, Agent, or Firm*—Stroock & Stroock & Lavan LLP

(57) ABSTRACT

Cartridge total weight SN of an ink bag filled with ink is measured. Ink weight SU of ink stored in the ink bag is calculated from the found cartridge total weight SN (step S17). The ink weight SU is converted into a printable amount and this printable amount is stored in an IC chip as an initial value Sc for calculating a remaining amount (step S19). A printer reads the initial value Sc for calculating the remaining amount from the IC chip, subtracts the ink consumption amount from the initial value Sc for calculating the remaining amount to calculate a new ink remaining amount, and stores the calculated ink remaining amount in the IC chip.

18 Claims, 10 Drawing Sheets

LIQUID CONTAINER, METHOD OF MANUFACTURING THE SAME, AND METHOD AND PROGRAM OF CONTROLLING LIQUID EJECTING DEVICE

BACKGROUND OF THE INVENTION

This invention relates to a liquid container, a method of manufacturing the liquid container, and a control method and a program of a liquid ejecting device.

Hitherto, an ink jet printer for ejecting ink droplets onto paper, etc., has been available as a liquid ejecting device. Usually, the ink jet printer includes a replaceable ink cartridge storing ink. When all ink in the ink cartridge is consumed, the ink cartridge is replaced with a new ink cartridge filled with ink.

Some ink cartridges are fixedly placed in a printer without being mounted on a carriage for use with a printer for executing a large amount of print. (For example, refer to Japanese Patent Publication No. JP-A-10-193635.) The ink cartridge usually is made up of an ink pack shaped like a bag, made of a flexible film and a case housing the ink pack.

On the other hand, some ink cartridges include each a memory device storing information concerning ink. (For example, refer to International Publication No. 01/92017 pamphlet.) In the printer, information indicating the ink remaining amount can be read from the memory device and can be displayed on a monitor for informing the user of the ink remaining amount.

In such an ink cartridge, to keep track of the ink remaining amount more precisely, the ink fill amount is stored in the memory device before the ink cartridge is used. The printer calculates the printer-consumed ink amount (the amount of ink consumed in printing and the amount of ink consumed in maintenance operation of cleaning, etc.,) from the ink fill amount read from the memory device, and stores the ink remaining amount in the memory device. Whenever printing, maintenance operation, or the like is performed for consuming ink, the printer subtracts the consumed ink amount from the ink remaining amount read from the memory device. Then, the printer stores the subtraction result value in the memory device as a new ink remaining amount. Further, when the ink remaining amount stored in the memory device reaches zero, the printer determines that all ink in the ink cartridge has been consumed, and prompts the user to replace the ink cartridge.

Usually, the ink fill amount stored in the memory device placed in one virgin ink cartridge is the same as that in the memory device placed in another virgin ink cartridge. That is, the lowest link amount enabling printing in any ink cartridge is set in the memory device as the printable amount used as the initial value for calculating the ink remaining amount.

As the amount of ink actually filled into an ink cartridge, ink is filled so as to satisfy the printable amount used as the reference, but the ink amount exceeding the reference value in one ink cartridge and that in another ink cartridge cannot be made uniform because of a fill amount error. Thus, the consumable ink amount varies from one ink cartridge to another. Therefore, the initial value for calculating the ink remaining amount stored in the memory device is not a value considering the ink fill amount error.

On the other hand, to use an ink cartridge filled with a larger amount of ink than the reference value, the printer also calculates the ink remaining amount based on the uniform ink fill amount stored in the memory device, as described above. Thus, if a large error exists between the uniform ink fill amount stored in the memory device and the actual ink fill amount, although the ink remaining amount calculated based on the value stored in the memory device is almost zero, the ink cartridge may still contain ink for enabling printing. However, the user determines that the ink cartridge becomes empty of ink based on the ink remaining amount information based on the memory device, and replaces the ink cartridge with a new one. That is, although ink still remains, the ink cartridge is replaced and is discarded before all ink is consumed, resulting in wasting the resources.

SUMMARY OF THE INVENTION

It is therefore an object of the invention to provide a liquid container, a method of manufacturing the liquid container, and a control method and a program of a liquid ejecting device for making it possible to consume almost all stored liquid for making effective use of the resources.

(1) To the end, according to the invention, there is provided a liquid container for storing liquid, the liquid container including a memory device for storing information concerning the liquid, wherein the memory device stores total weight of the liquid container measured in a virgin condition or an initial value for calculating a remaining amount calculation based on the total weight.

(2) As the invention, in the liquid container of (1), the liquid is filled into a liquid storage bag made of a flexible film and the liquid storage bag is housed in a case.

(3) As the invention, in the liquid container of (2), the memory device stores total weight of the liquid storage bag measured in a virgin condition as the total weight of the liquid container.

(4) As the invention, in the liquid container of (2), the memory device stores total weight of the liquid storage bag and the case measured in a virgin condition as the total weight of the liquid container.

(5) According to the invention, there is provided a manufacturing method of a liquid container for storing liquid, the liquid container including a memory device for storing information concerning the liquid, the manufacturing method including a measuring step of measuring total weight of the liquid container with the liquid stored therein; and a storage step of storing the measured total weight of the liquid container or an initial value for calculating a remaining amount based on the total weight in the memory device.

(6) As the invention, in the manufacturing method of the liquid container of (5), the liquid container is a liquid container including a liquid storage bag made of a flexible film for storing the liquid, and the manufacturing method further includes a forming step of injecting the liquid through an opening of the liquid storage bag formed with the part opened and sealing the liquid storage bag at a lower position than the liquid level of the injected liquid, thereby forming the liquid storage bag storing the liquid in a hermetical seal state.

(7) According to the invention, there is provided a control method of a liquid ejecting device for ejecting liquid supplied from a liquid container including a memory device storing the remaining amount of stored liquid, the control method including the step of calculating and storing the liquid remaining amount calculated from the consumption amount of the liquid and an initial value for calculating a remaining amount based on total weight of the liquid container measured in a virgin condition stored in the memory device placed in the liquid container.

(8) As the invention, in the control method of the liquid ejecting device of (7), the total weight of the liquid container is stored in the memory device, and the control method further includes the step of calculating the initial value for calculating the remaining amount based on the total weight of the liquid container when use of the liquid container is started.

(9) According to the invention, there is provided a program for causing a computer for controlling a liquid ejecting device for ejecting liquid supplied from a liquid container to implement a function of calculating and storing the liquid remaining amount calculated from the consumption amount of the liquid and an initial value for calculating a remaining amount based on total weight of the liquid container measured in a virgin condition stored in a memory device placed in the liquid container.

(10) As the invention, the program of (9) causes the computer to further implement a function of calculating the initial value for calculating a remaining amount based on the total weight of the liquid container stored in the memory device placed in the liquid container when use of the liquid container is started.

According to the invention described above (1), (5), (7), or (9), the liquid remaining amount can be managed based on the total weight found by actually measuring the liquid container storing liquid or the initial value for the remaining amount based on the total weight of the liquid container. Thus, there is little error between the liquid remaining amount in the liquid container calculated from the memory device and the actual liquid remaining amount in the liquid container. That is, if the liquid remaining amount stored in the memory device becomes zero, the actual amount of the liquid remaining in the liquid container also becomes almost zero. Therefore, the stored liquid can be mostly consumed in any liquid container and effective use of the resources can be made. Since the initial value for the remaining amount is calculated based on the total weight of the liquid container storing liquid, the amount of the liquid in the liquid container can be found easily and more reliably. Here, the term "weight" contains not only "mass," but also every amount representing "weight."

According to the invention as described in (2) or (6), if liquid is stored in the liquid storage bag made of flexible films and it is hard to measure the volume of the liquid, the stored liquid amount can be found more precisely. Since liquid is stored in a deaeration state, if the actual amount of the liquid stored in the liquid storage bag is less than the injected liquid amount, a value closer to the actual amount of the liquid stored in the liquid storage bag can be obtained.

According to the invention as described in (3), the total amount of the liquid storage bag filled with liquid in the liquid container made up of the liquid storage bag and the case is used as the total amount of the liquid container. Thus, the initial value for the remaining amount is calculated based on the total weight measured in a state in which the weight of any other component than the liquid in the liquid container is not contained as much as possible. Therefore, the error of the weight of any other component than the liquid in the liquid container can be lessened extremely, so that the initial value for the remaining amount still closer to the actually stored liquid amount can be obtained.

According to the invention as described in (4), the total weight of the liquid storage bag and the case measured in a virgin condition as the total weight of the liquid container is the total weight of the completed liquid container. Thus, in the manufacturing process, the completed liquid container is measured and the total weight of the liquid container measured is stored intact in the memory device, so that the processing in the manufacturing process can be simplified.

According to the invention as described in (8) or (10), when use of the liquid container is started, namely, the liquid container is filled with liquid, the initial value for the remaining amount is calculated. Thus, the processing in the manufacturing process or at the liquid ejecting time can be simplified.

DETAILED DESCRIPTION OF THE PREFERRED EMBODIMENTS

First Embodiment

A firs embedment of the invention will be discussed with reference to FIGS. 1 to 9.

Figure 1:
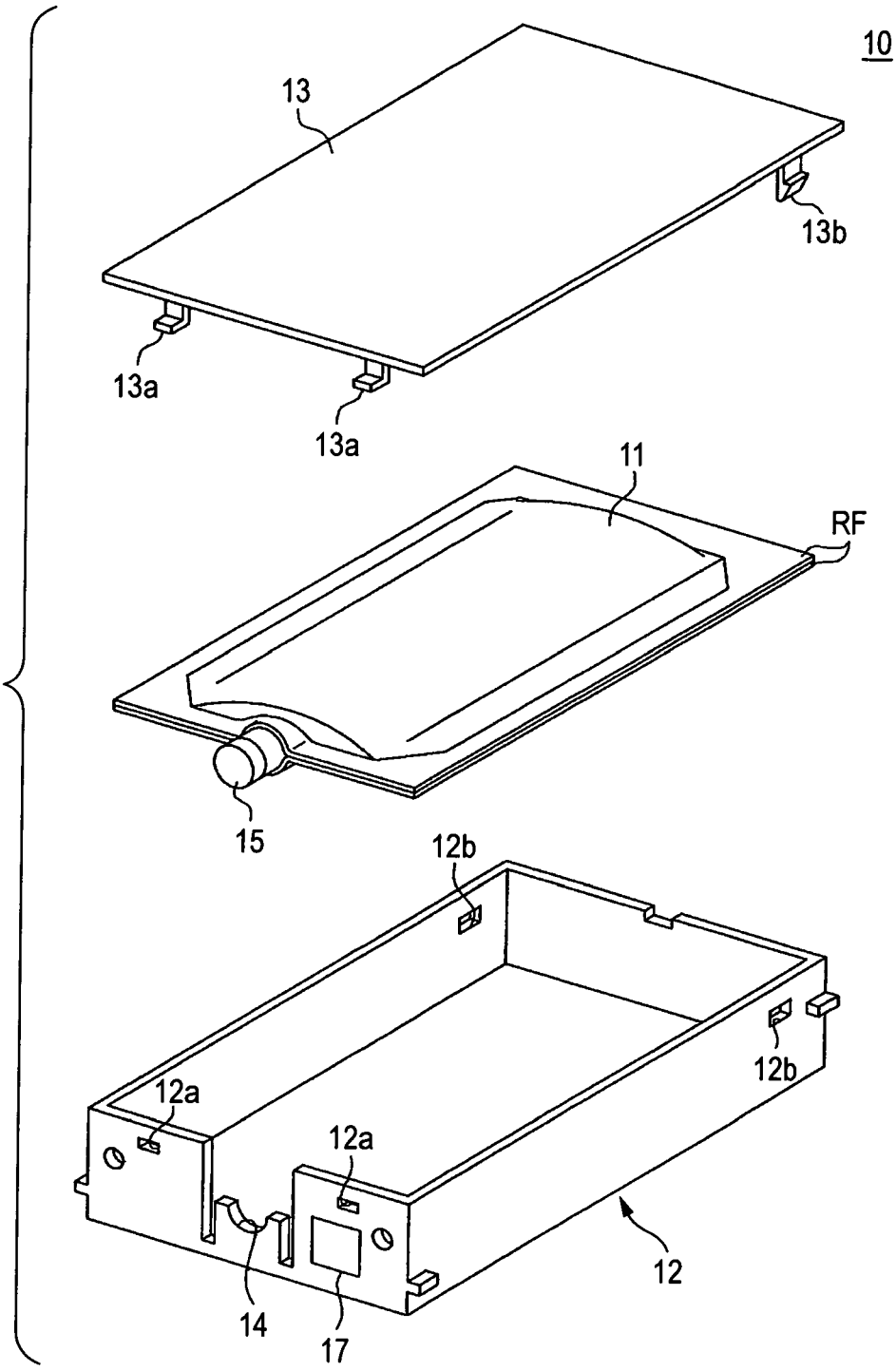
FIG. 1 is an exploded perspective view of an ink cartridge in a first embodiment of the invention.

An ink cartridge 10 as a liquid container of the embodiment has an ink bag 11 as a liquid storage bag storing ink (liquid), a case 12 shaped like a rectangular box, and a plate-like lid 13 covering the top of the case 12, as shown in FIG. 1.

The ink bag 11 is made up of a tubular ink derivation section 15 and two rectangular laminated films RFs. With the ink derivation section 15 sandwiched between the two superposed laminated films RFs, their surroundings are joined by thermal welding, thereby forming the ink bag 11 like a bag. Ink having a specific color is stored in the ink bag 11 in a fluid-tight state.

The case 12 has a recess 14 in one side wall and the ink derivation section 15 of the ink bag 11 is fitted into the recess 14 for support, thereby housing the ink bag 11. The case 12 has a plurality of engagement holes 12*a* and 12*b* made in upper portions of the side walls.

The case 12 includes an IC chip 17 as a memory device placed on the side wall where the recess 14 is formed. The IC chip 17 stores cartridge information and ink attribute information. The cartridge information is information about the ink cartridge 10, such as the cartridge type, the number of times the cartridge has been mounted, and the cartridge manufacturing date. The ink attribute information is information concerning the ink stored in the ink bag 11, such as the ink color and the ink remaining amount.

On the other hand, the lid 13 is provided with engagement protrusion parts 13*a* and 13*b* each roughly shaped like a letter L. The engagement protrusion parts 13*a* and 13*b* can be fitted into the engagement holes 12*a* and 12*b* of the case 12. Thus, as the engagement protrusion parts 13*a* and 13*b* of the lid 13 are engaged with the engagement holes 12*a* and 12*b*, the lid 13 is integrated into the case 12 housing the ink bag 11 and covers the top of the case 12.

Figure 2:
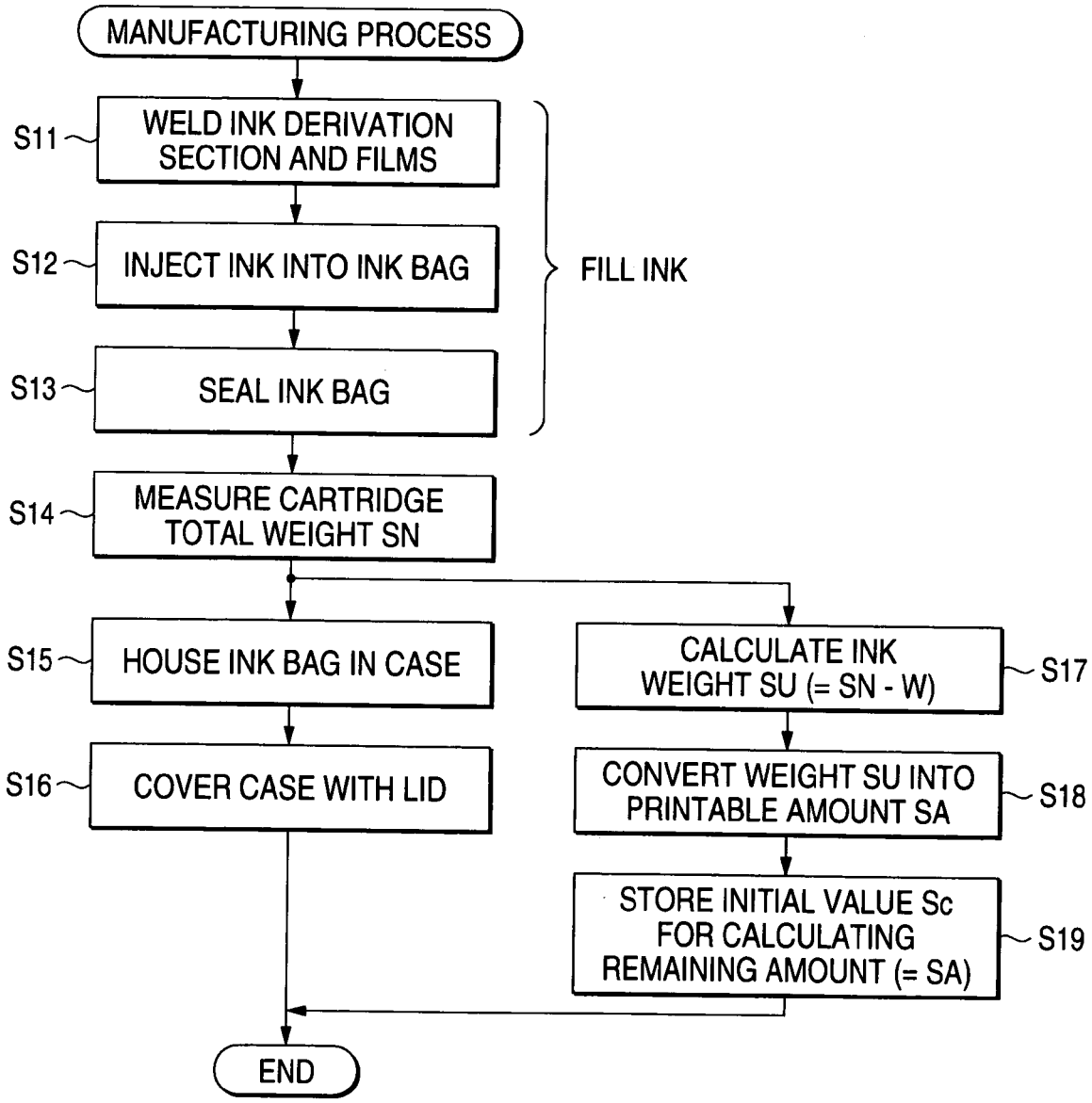
FIG. 2 is a flowchart of a manufacturing process of the ink cartridge in the first embodiment of the invention.

Next, a manufacturing method of the ink cartridge 10 of the embodiment will be discussed with reference to FIG. 2.

Figure 3A:
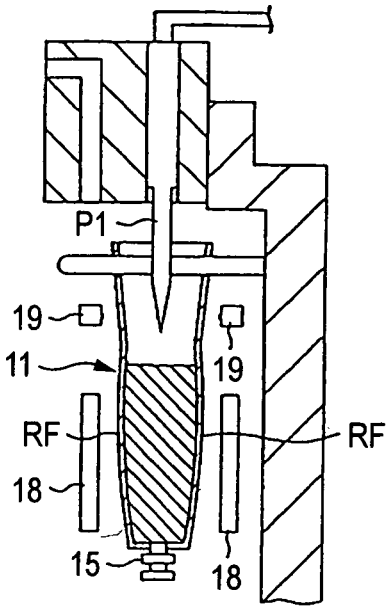
FIGS. 3A and 3B are sectional views of the ink cartridge in the manufacturing process in the first embodiment of the invention; 3A shows a state in which the ink cartridge is filled with ink and 3B shows a state in which an ink bag is tack-sealed.

First, the ink bag 11 of the ink cartridge 10 is filled with ink. In detail, with the ink derivation section 15 sandwiched between the two rectangular laminated films RFs, their surroundings are thermally welded (step S11). At this time, however, the opposite side to the side where the ink derivation section 15 is welded is not thermally welded and is open to inject ink, as shown in FIG. 3A. The opening is formed with a pair of retention holes (not shown). The weight of the laminated films RFs and the ink derivation section 15 in one piece, which will be hereinafter referred to as member weight W, is previously measured.

Figure 4:
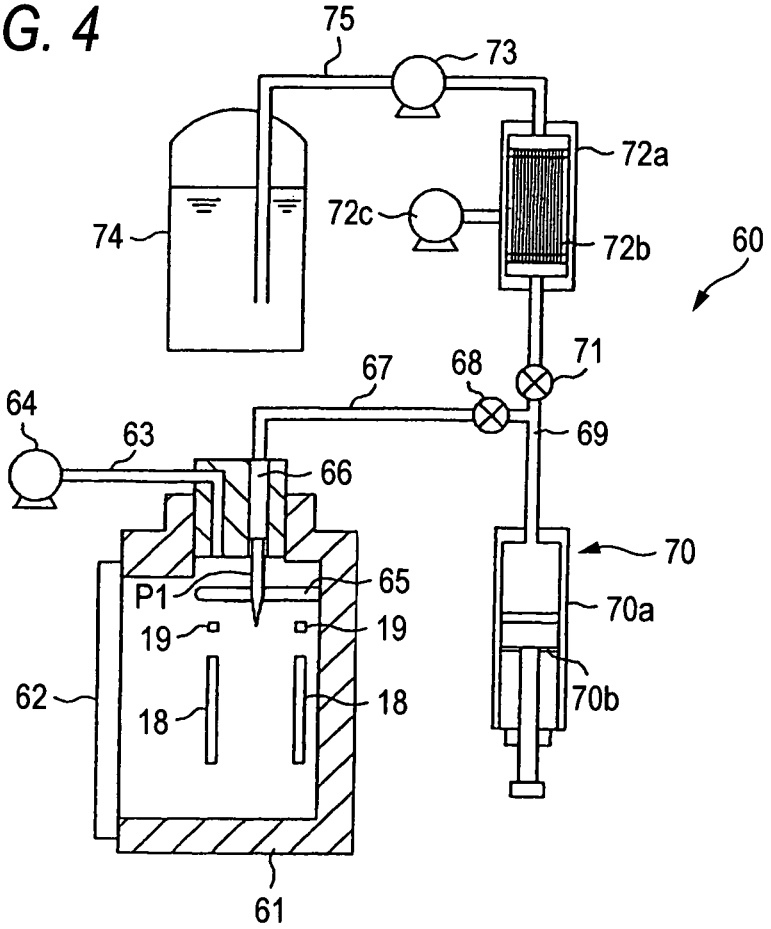
FIG. 4 is a schematic drawing of an ink injection apparatus in the manufacturing process in the first embodiment of the invention.

Next, using an ink injection apparatus 60 shown in FIG. 4, ink is injected and the ink bag is sealed. The ink injection apparatus 60 includes a decompression chamber 61 that can be opened and closed by a door 62. The decompression chamber 61 is connected to a vacuum pump 64 by a flow passage pipe 63 and decompression can be conducted. In the decompression chamber 61, a bag support rod 65 for hooking the ink bag 11 is projected in a horizontal direction. Further, a pair of press plates 18 and a pair of thermo-compression bonding devices 19 that can be brought close to each other are placed in the decompression chamber 61. The thermo-compression bonding devices 19 are used to thermally weld the laminated films RFs of the ink bag 11 and can be moved up and down. Further, a supply pipe P1 is placed above the thermo-compression bonding devices 19. The supply pipe P1 is a supply pipe inserted into the ink bag 11 to inject ink into the placed ink bag 11. As the supply pipe P1 moves up and down relative to a needle insertion member 66, the supply pipe P1 can come and go in the decompression chamber 61.

A tube 67 continuing to the outside of the decompression chamber 61 is connected to the needle insertion member 66. The tube 67 is connected to a first valve 68, which is connected to a branch pipe 69. A measuring pipe 70 for measuring the volume of injected ink is connected to one side of the branch pipe 69. The measuring pipe 70 is made up of a cylinder 70*a* and a piston 70*b*. When the piston 70*b* reaches a predetermined position, a predetermined volume amount of ink is stored in the cylinder 70*a*.

A tank connection pipe 75 continuing to an ink tank 74 storing ink is connected to an opposite side of the branch pipe 69. The tank connection pipe 75 is provided with a second valve 71, a liquid-vapor separation unit 72, and a pump 73. The liquid-vapor separation unit 72 is made up of a cylinder 72*a*, a plurality of hollow yarn bundles 72*b* connected at both ends to the cylinder 72*a*, and a vacuum pump 72*c* for forming a negative pressure in the surroundings of the hollow yarn bundles 72*b*. As ink supplied from the ink tank 74 passes through the hollow yarn bundles 72*b*, the liquid-vapor separation unit 72 deaerates the ink. The pump 73 is a pump for delivering the ink stored in the ink tank 74 to the branch pipe 69 by pressure.

Figure 5A:
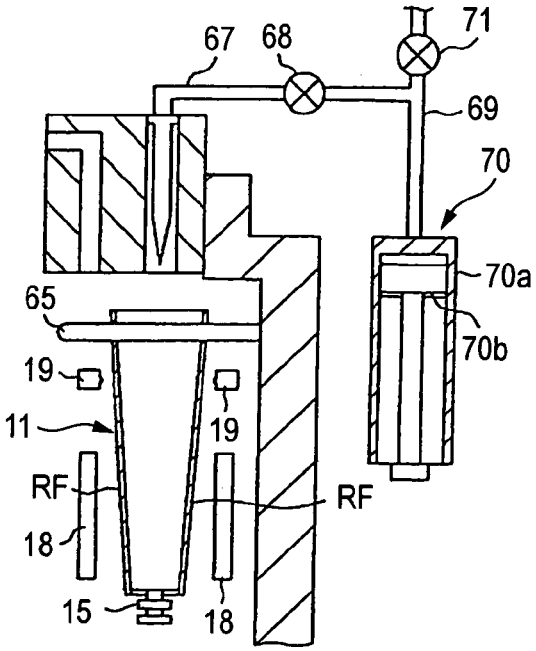
FIGS. 5A and 5B are sectional views of the ink cartridge in the manufacturing process in the first embodiment of the invention; 5A shows a state in which the ink bag is placed and 5B shows a state in which ink is weighed.

The ink bag 11 with three sides welded is placed in the decompression chamber 61 of the ink injection apparatus 60. In detail, the ink bag 11 is placed between the paired press plates 18 and thermo-compression bonding devices 19 in the decompression chamber 61 and the retention hole is hooked on the bag support rod 65. At this time, the ink bag 11 is placed so that the open side becomes the top, namely, the supply pipe P1 can be inserted from above, as shown in FIG. 5A. Then, the door 62 is closed and the decompression chamber 61 is placed in a hermetical seal state. The vacuum pump 64 is driven with the second valve 71 closed and the first valve 68 open. Accordingly, the pressure in the decompression chamber 61, the tube 67, and the measuring pipe 70 is reduced. When the pressure is reduced to a predetermined pressure, the first valve 68 is closed, the second valve 71 is opened, and the pump 73 is driven. Accordingly, from the ink tank 74 in FIGS. 5A and 5B, ink flows into the measuring pipe 70 and the piston 70*b* is retracted. The ink flowing into the measuring pipe 70 is deaerated because it passes through the liquid-vapor separation unit 72.

Figure 5B:
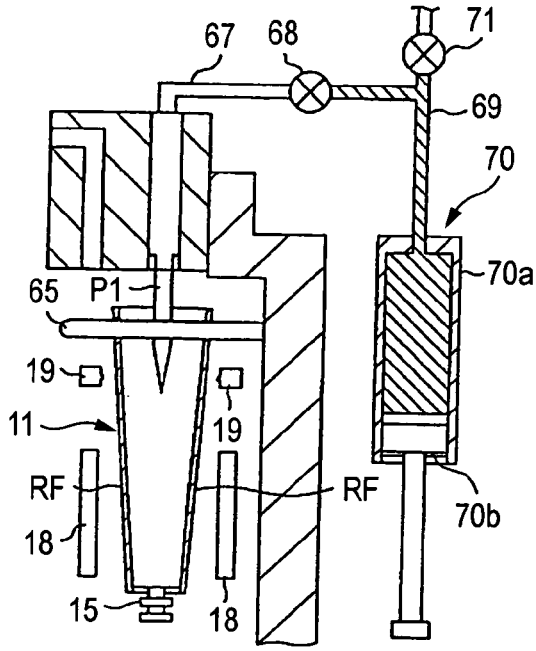

After this, as shown in FIG. 5B, when a predetermined volume of ink flows into the measuring pipe 70 and the piston 70*b* reaches a predetermined position, the second valve 71 is closed. Next, the supply pipe P1 is moved down so that it is positioned in the ink bag 11. When the first valve 68 is opened and the piston 70*b* is advanced, the measured ink in the measuring pipe 70 flows into the ink bag 11. That is, as shown in FIG. 3A, the ink is injected into the ink bag 11 through the supply pipe P1 from the top not thermally welded (step S12).

Figure 3B:
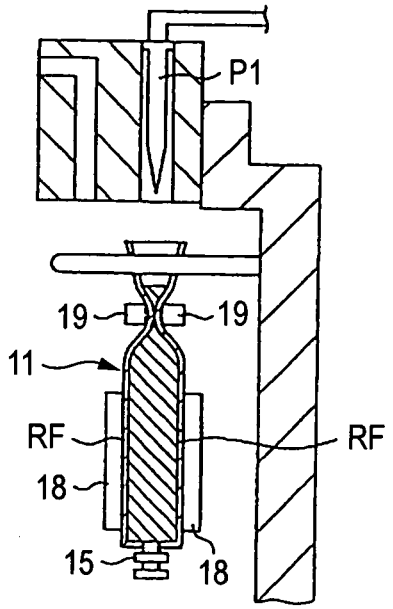
Figure 6A:
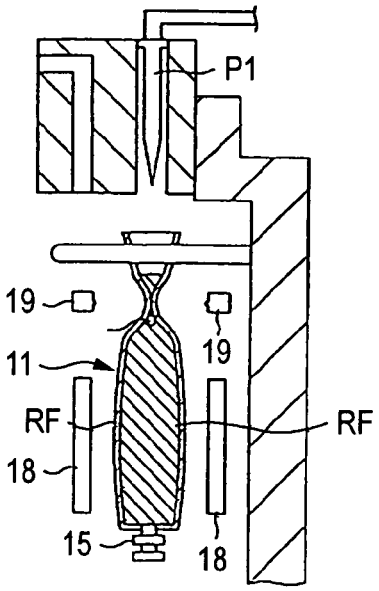
FIGS. 6A and 6B are sectional views of the ink cartridge in the manufacturing process in the first embodiment of the invention; 6A shows a state in which a heating plate is removed after tack seal and 6B shows a state in which the ink bag is regularly sealed.
Figure 6B:
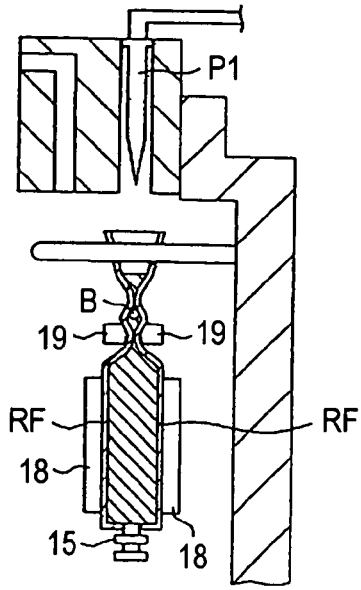

Next, the press plates 18 are brought close to each other for pressing the ink bag 11 from both sides thereof so that the ink bag 11 becomes a predetermined thickness. Accordingly, the liquid level of the ink supplied to the ink bag 11 is raised. The ink bag 11 is sandwiched between the thermo-compression bonding devices 19 at a little higher position than the ink bag 11 as a product and is tack-sealed by thermal welding, as shown in FIG. 3B. After the tack sealing, as shown in FIG. 6A, the press plates 18 and the thermo-compression bonding devices 19 are brought away from the ink bag 11 and air bubbles B left in the ink bag 11 are gathered in the narrowed tack seal part. Again the press plates 18 are brought close to each other and as shown in FIG. 6B, the ink bag 11 is sandwiched between the thermo-compression bonding devices 19 at a lower position than the tack seal part and is thermally welded for regular sealing of the ink bag 11 (step S13). The upper part containing the air bubbles B is discarded. The complete ink bag 11 storing ink deaerated without containing any air bubbles B is now produced.

Next, the complete ink bag 11 filled with ink is taken out from the decompression chamber 61 of the ink injection apparatus 60 and is transported to a weighing instrument (not shown) and the total weight of the ink bag 11, which will be hereinafter referred to as cartridge total weight SN, is measured (step S14). The cartridge total weight SN is represented in gram units in the embodiment and corresponds to the total weight of the liquid container in the embodiment. Upon completion of measuring the cartridge total weight SN, the ink bag 11 is housed in the case 12 provided with the IC chip 17. That is, the ink derivation section 15 of the ink bag 11 is fitted into the recess 14 of the case 12 for support, and the ink bag 11 is housed in the case 12 (step S15). Next, when the case 12 housing the ink bag 11 is covered with the lid 13, the ink cartridge 10 is formed (step S16).

On the other hand, the data of the cartridge total weight SN of the ink cartridge 11 measured with the weighing instrument is transmitted to a manufacturing management computer (not shown). The manufacturing management computer is a computer for managing the manufacturing steps of the ink cartridge 10, namely, the measuring stage, the data storage stage, and the formation stage of the ink cartridge 10. The manufacturing management computer subtracts the member weight W from the found cartridge total weight SN to calculate ink weight SU of ink stored in the ink bag 11 (=SN-W) (step S17). Subsequently, the manufacturing management computer converts the calculated ink weight SU into printable amount SA represented in little units (step S18). The provided printable amount SA is written into the IC chip 17 as an initial value Sc for calculating a remaining amount together with the ink attribution information and the cartridge information (step S19). The ink cartridge 10 is now completed.

Next, the use method of the ink cartridge 10 thus completed will be discussed with reference to FIGS. 7 to 9.

Figure 7:
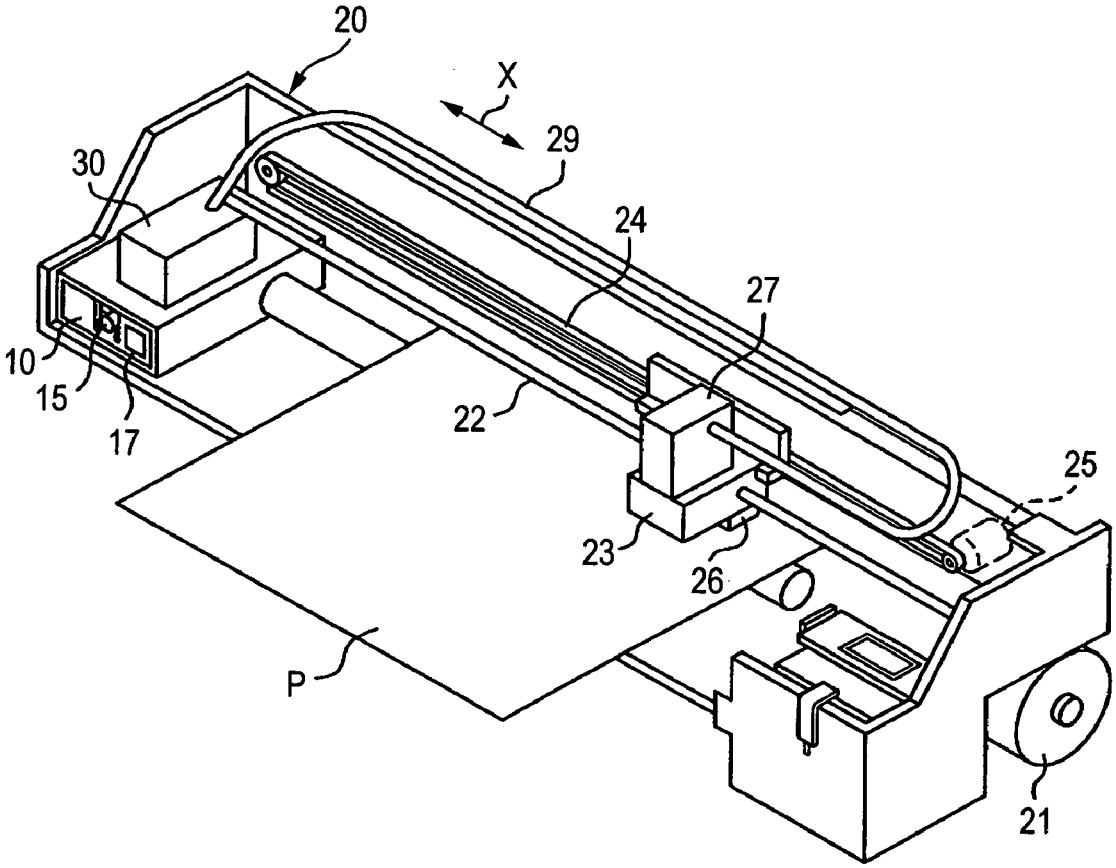
FIG. 7 is a perspective view of a printer in which the ink cartridge in the first embodiment of the invention is installed.

The ink cartridge 10 is disposed in a side part of a printer 20 as shown in FIG. 7 for use. The printer 20 includes a paper feed motor 21 and can transport paper P to the front intermittently by driving the paper feed motor 21. The printer 20 also includes a carriage 23 that can be reciprocated in a main scanning direction X parallel with the axial direction of a guide shaft 22 as the carriage 23 is guided by the guide shaft 22. The carriage 23 is joined to a carriage motor 25 through a timing belt 24 and is driven by the driving force of the carriage motor 25.

A print head 26 as a liquid ejection head is disposed on the bottom of the carriage 23. The print head 26 is formed with a plurality of nozzle rows and is also provided with piezoelectric elements 28 (shown in FIG. 8) for ejecting ink from the nozzles.

A subtank 27 is placed on the top of the carriage 23. The subtank 27 is connected to a supply pump 30 through a tube 29. Further, the supply pump 30 is connected through a tube (not shown) to the ink derivation section 15 of the ink bag 11 of the ink cartridge 10.

Therefore, as the supply pump 30 is driven, ink in the ink bag 11 of the ink cartridge 10 is supplied through the tube 29 to the subtank 27 on the carriage 23. While reciprocating the carriage 23 by driving the carriage motor 25, the printer 20 ejects ink supplied to the subtank 27 onto paper P.

Figure 8:
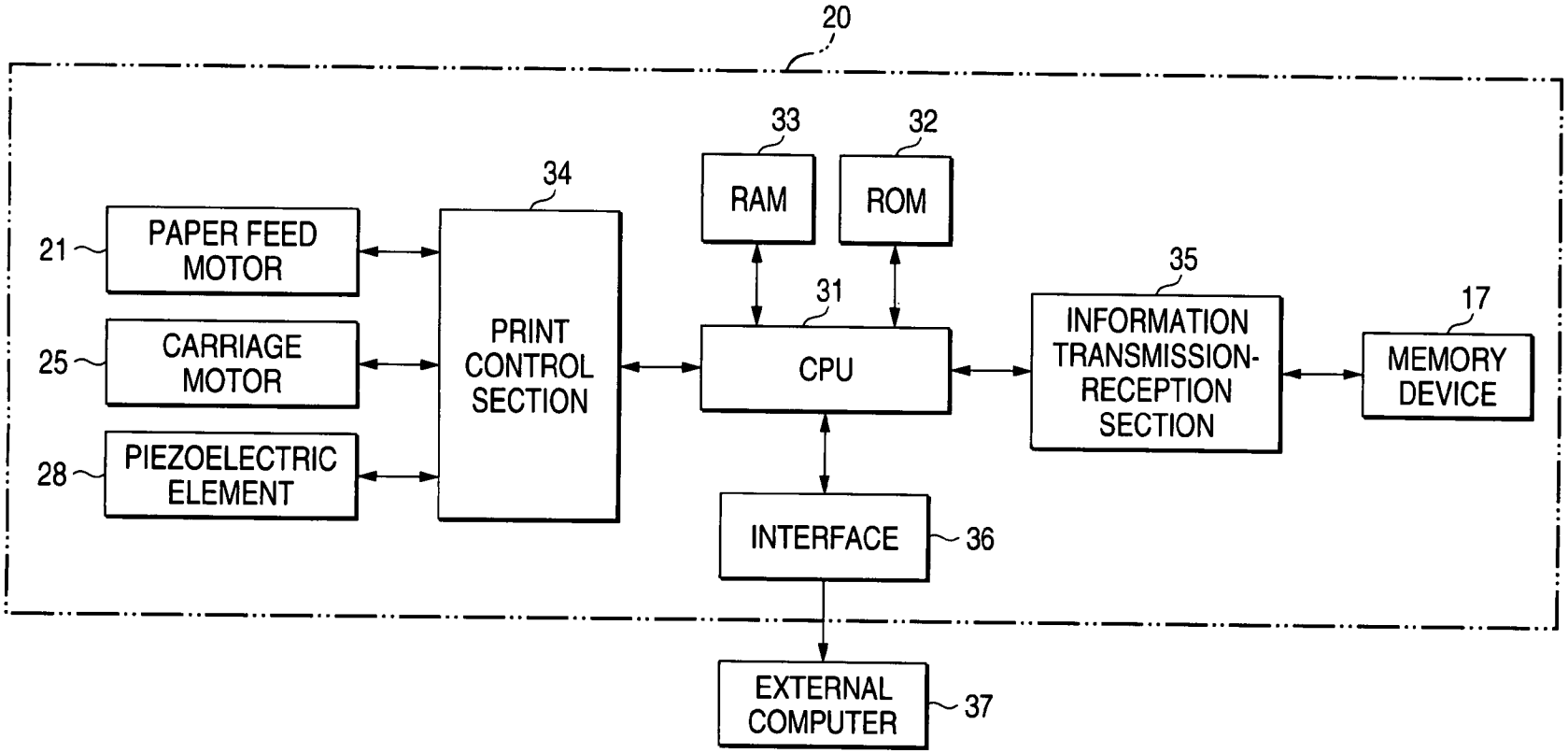
FIG. 8 is a block diagram to show the electric configuration of the printer in FIG. 7.

On the other hand, the printer 20 includes a central processing unit (CPU) 31, ROM 32, RAM 33, a print control section 34, an information transmission-reception section 35, and an interface 36, as shown in FIG. 8.

The CPU 31 functions as a computer for controlling the liquid ejecting apparatus for ejecting liquid supplied from the liquid container. The CPU 31, which is connected through the interface 36 to an external computer 37, inputs print data, etc., from the external computer 37 and outputs information of indication of ink remaining amount S, etc., to the external computer 37. The CPU 31 is connected to the IC chip 17 of the ink cartridge 10 through the information transmission-reception section 35 and a connection terminal (not shown) and reads information stored in the IC chip and writes information into the IC chip 17 in a contact manner.

The ROM 32 stores various programs such as a print program and the RAM 33 temporarily stores the processing result. Thus, the CPU 31 operates in accordance with the various programs in the ROM 32 and temporarily stores the operation result, etc., in the RAM 33.

Further, the CPU 31 is connected through the print control section 34 to the paper feed motor 21, the carriage motor 25, and the piezoelectric elements 28. Thus, the CPU 31 appropriately drives the paper feed motor 21, the carriage motor 25 and the piezoelectric elements 28 for transporting paper P and moving the carriage 23, and drives the piezoelectric elements 28 for printing on the paper P.

Figure 9:
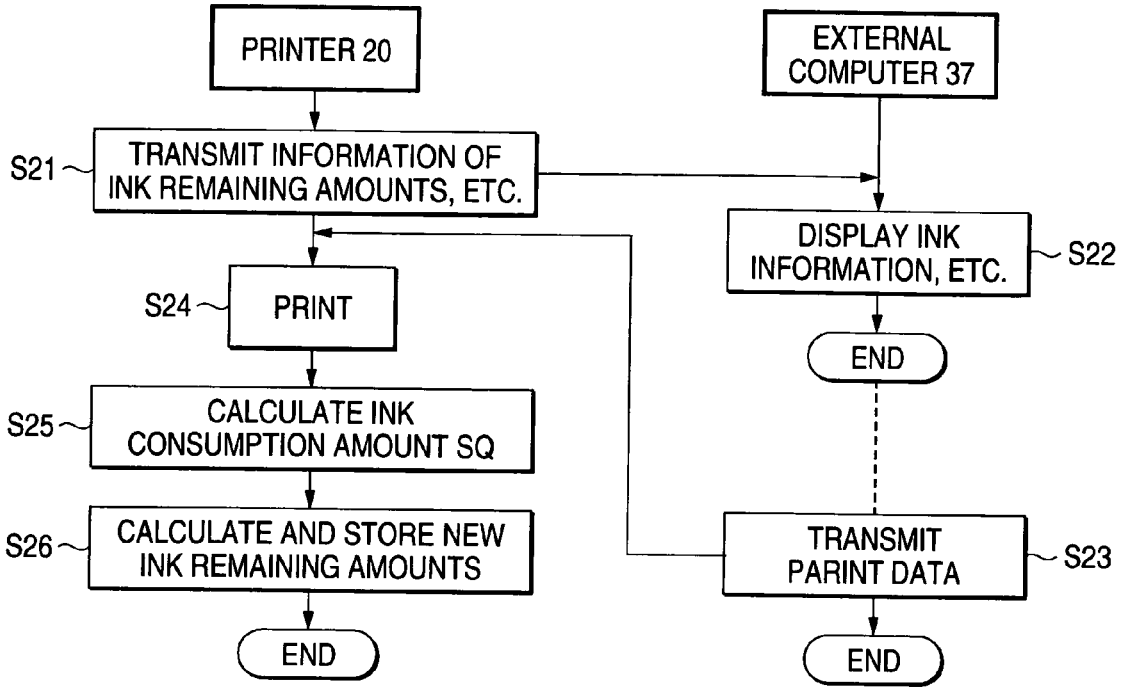
FIG. 9 is a flowchart of print processing of the printer in the first embodiment of the invention.

At the printing time, print processing shown in FIG. 9 is performed.

That is, when power of the printer 20 is turned on, the CPU 31 acquires the cartridge information and the ink attribute information in the IC chip 17 of the ink cartridge 10 through the information transmission-reception section 35. That is, the CPU 31 acquires the information about the number of times the ink cartridge 10 has been mounted and the manufacturing date of the ink cartridge 10 and the information about the stored ink color and the ink remaining amount S. The CPU 31 transmits the information about the ink remaining amount S through the interface 36 to the external computer 37 (step S21). The external computer 37 displays the ink remaining amount based on the received information (step S22). At this time, if the virgin ink cartridge 10 is just installed in the printer 20, the ink remaining amount S is the initial value Sc for calculating the remaining amount, namely, the printable amount SA.

When print information is transmitted from the external computer 37 to the printer 20 (step S23), the CPU 31 drives the ROM 32, the RAM 33, and the print control section 34 for printing based on the print information (step S24). At this time, the CPU 31 stores the number of times each nozzle has ejected ink and the ejection amount of each ink droplet (in little units) in the RAM 33.

At the termination of the printing, the CPU 31 calculates ink consumption amount SQ (in little units) in the printing from the number of times each nozzle has ejected ink and the ejection amount of each ink droplet stored in the RAM 33 (step S25). The CPU 31 subtracts the consumption amount SQ from the ink remaining amount S (in the beginning, the initial value Sc for calculating the remaining amount) read from the IP chip 17 to calculate new ink remaining amount S (in little units), and stores the new ink remaining amount S in the IC chip 17 of the ink cartridge 10 (step S26).

Whenever printing is performed, the print processing is repeated.

Ink is also consumed in the maintenance operation of cleaning, etc. Thus, as the ink consumption amount at this time, predetermined ink consumption amount for each maintenance operation is also subtracted from the ink remaining amount read from the IC chip 17 to calculate new ink remaining amount, and the new ink remaining amount is stored in the IC chip 17 of the ink cartridge 10.

When the above-described operation is performed and the ink remaining amount S stored in the IC chip 17 becomes zero, the remaining amount of the ink actually stored in the ink cartridge 10 also becomes almost zero.

According to the ink cartridge 10 of the embodiment, the following advantages can be provided:

(1) In the embodiment, the cartridge total weight SN of the total amount of the ink bag 11 storing ink is measured and the printable amount SA is calculated based on the cartridge total weight SN and is stored in the IC chip 17 as the initial value Sc for calculating the remaining amount (step S19). The ink remaining amount S is calculated based on the initial value Sc for calculating the remaining amount. That is, the initial value Sc for calculating the remaining amount is determined based on the amount of ink actually stored in the ink bag 11. This almost eliminates the error between the ink remaining amount S calculated from the initial value Sc for calculating the remaining amount stored in the IC chip 17 and the remaining amount of ink actually stored in the ink cartridge 10. Therefore, when the remaining amount calculated from the initial value Sc for calculating the remaining amount becomes almost zero, the ink in the ink cartridge 10 also becomes almost zero and can be completely consumed. Therefore, the ink in the ink bag 11 can be mostly used, so that effective use of the resources can be made.

(2) In the embodiment, the cartridge total weight SN of the ink bag 11 is measured with the weighing instrument (not shown) and the initial value Sc for calculating the remaining amount is found. That is, the initial value Sc for calculating the remaining amount is calculated based on the weight that can be actually measured easily from the ink cartridge 10, so that the initial value Sc for calculating the remaining amount responsive to the weight SU of ink actually stored in the ink bag 11 can be found easily and more reliably.

(3) In the embodiment, the printable amount SA into which the ink weight SU based on the cartridge total weight SN is converted in little units like the ink remaining amount S is stored in the IC chip 17 as the initial value Sc for calculating the remaining amount. Thus, the printer 20 can subtract the ink consumption amount in each printing to find a new ink remaining amount S easily. That is, calculation processing of the ink remaining amount S in the printer 20 can be simplified.

(4) The ink cartridge 10 of the embodiment includes the ink bag 11 formed of the flexible laminated films RFs and it is hard to measure the volume. Even in such an ink cartridge, the weight (mass) is measured, whereby the actually stored ink amount can be found easily.

(5) In the embodiment, the cartridge total weight SN of the ink bag 11 before being housed in the case 12 is measured. Thus, the cartridge total weight SN can be found in a state in which extra weight except ink is not contained as much as possible, namely, in a state in which the weight error of the case 12, the IC chip 17, etc., is not contained. Therefore, the ink weight SU of a value closer to the amount of ink actually stored in the ink bag 11 can be found and the printable amount SA closer to the actually printable amount can be obtained.

(6) In the embodiment, the ink bag 11 is sealed at a lower position than the liquid level of ink injected into the ink bag 11 so as to prevent the air bubbles B from being contained in the ink bag 11. Thus, a smaller amount of ink than the ink amount measured with the measuring pipe 70 is stored in the ink bag 11. In the embodiment, however, the weight of the ink bag 11 is measured after the ink bag 11 is completed, so that the amount of ink in the ink bag 11 can be found more precisely and the stored ink can be used more effectively.

(7) In the embodiment, the ink bag 11 is tack-sealed at a lower position than the liquid level of ink injected into the ink bag 11 and further is regularly sealed at a lower position than the tack seal position. Accordingly, more deaerated ink is stored in the ink bag 11 and thus remaining dissolved gas contained in ink can be excluded as much as possible, so that degradation of the ink droplet ejection performance of the printer 20 can be suppressed as much as possible.

Second Embodiment

Next, a second embodiment of the invention will be discussed with reference to FIGS. 10 and 11. A liquid container of the embodiment has almost the same structure as the ink cartridge 10 of the first embodiment and therefore similar parts are denoted by the same reference numerals and will be not be discussed again in detail. In the second embodiment, in a manufacturing process, measurement data of the total weight of an ink cartridge 10 is stored intact in an IC chip 17 of the ink cartridge 10, and an initial value Sc for calculating the remaining amount is calculated when the ink cartridge 10 is first installed in a printer 20.

In the embodiment, ROM 32 of the printer 20 stores the weight of unavailable ink, which will be hereinafter referred to as unavailable amount UA, in mass units (for example, gram units) about the ink cartridge 10 that can be installed. The unavailable amount UA is the sum of the vessel weight of the ink cartridge 10 (total weight of an ink bag, a case 12, the IC chip 17, etc., other than ink) and the weight of ink that cannot completely be consumed. The vessel weight of the ink cartridge 10 is the total vessel weight before ink is injected. The weight of ink that cannot completely be consumed is the weight of ink unused and remaining in the ink cartridge 10 theoretically or empirically because of the structure of the ink cartridge 10.

Figure 10:
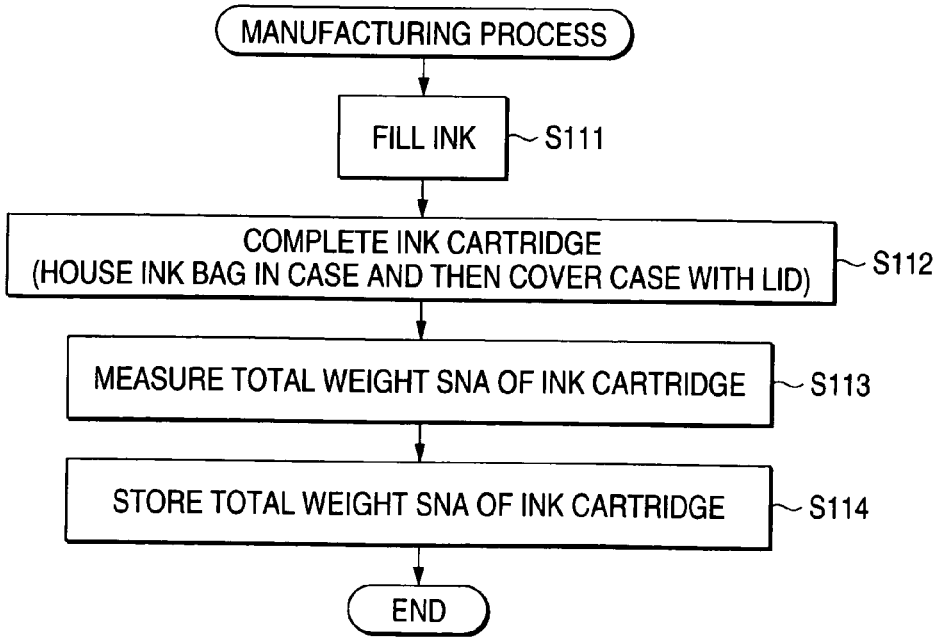
FIG. 10 is a flowchart of a manufacturing process of an ink cartridge in a second embodiment of the invention.

The ink cartridge 10 of the embodiment is manufactured according to a procedure shown in FIG. 10. To begin with, as in the first embodiment, the ink bag 11 is filled with ink (step S111). That is, with an ink derivation section 15 sandwiched between two laminated films RFs, three sides of the laminated films RFs are thermally welded. The ink bag 11 with one side open is placed in the ink injection apparatus 60 in FIG. 4. As in the first embodiment, ink is injected into the ink bag 11 and the open side is sealed, completing the ink bag 11.

Next, the complete ink bag 11 is housed in the case 12 and further a lid 13 is fitted into the case 12. The ink cartridge 10 is now completed (step S112). The IC chip 17 is already attached to the case 12 before the ink cartridge 10 is completed.

The ink cartridge 10 is transported to a weighing instrument (not shown) and total weight SNA of the ink cartridge 10 is measured (step S113). The measurement data of the total weight SNA is transmitted to a manufacturing management computer (not shown). The manufacturing management computer writes the total weight SNA of the ink cartridge 10 into the IC chip 17 for storage in mass units (step S114). Accordingly, the ink cartridge 10 of the embodiment is completed. That is, the total weight SNA of the ink cartridge 10 is stored in the IC chip 17 of the completed ink cartridge 10.

Figure 11:
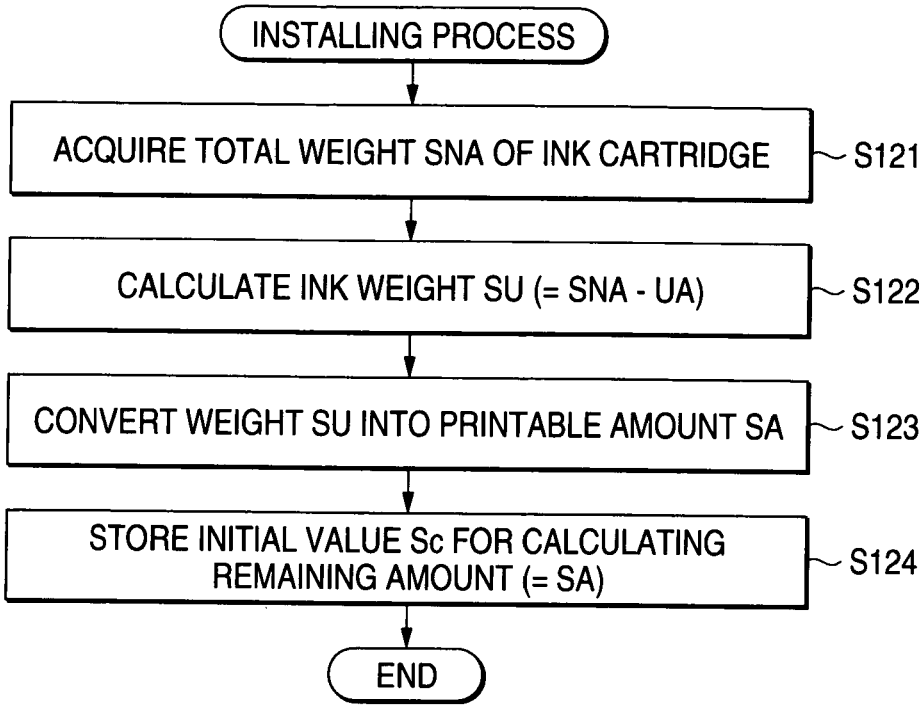
FIG. 11 is a flowchart of an installing process of the ink cartridge in the second embodiment of the invention.

After this, when the virgin ink cartridge 10 is installed in the printer 20, an installing process shown in FIG. 11 is performed. This installing process is executed if "the number of times the cartridge has been installed" in cartridge information stored in the IC chip 17 of the ink cartridge 10 is 0.

That is, when the ink cartridge 10 is installed in the printer 20, the printer 20 acquires information in the IC chip 17 placed in the ink cartridge 10 through information transmission-reception section 35. At this time, if "the number of times the cartridge has been installed" in the cartridge information stored in the IC chip 17 is 0, a CPU 31 of the printer 20 acquires the data of the total weight SNA stored in the IC chip 17 (step S121).

Next, the CPU 31 calculates ink weight SU (step S122). This ink weight SU is a value found by subtracting the unavailable amount UA stored in the ROM 32 from the total weight SNA acquired at step S121.

Subsequently, the CPU 31 converts the ink weight SU into printable amount SA (step S123). This printable amount SA is the number of times ink injection is possible in the embodiment. That is, the ink weight SU is divided by the amount of ink once ejected (for example, 2 ng), whereby the number of times ink injection is possible can be found. The printable amount SA is stored in the IC chip 17 as the initial value Sc for calculating the remaining amount of ink remaining amount S (step S124).

After this, when printing is executed, similar print processing to that in the first embodiment is performed. That is, before printing, information containing the ink remaining amount S stored in the IC chip 17 is transmitted to an external computer 37 and is displayed. During the printing, the number of injection times of ink consumed in the printing is stored in RAM 33. At the termination of the printing, the number of injection times stored in RAM 33 is subtracted from the initial value Sc for calculating the remaining amount, whereby a new ink remaining amount S (in the embodiment, the number of times injection is possible) is calculated. The new ink remaining amount S is stored in the IC chip 17 of the ink cartridge 10.

Whenever printing is executed, such print processing is repeated. When the ink remaining amount S stored in the IC chip 17 becomes zero, the remaining amount of the ink actually stored in the ink cartridge 10 also becomes almost zero, as in the first embodiment.

In the embodiment, the following advantages can be provided in addition to similar advantages to those described above in (1), (2), and (5) to (7) in the first embodiment:

(8) In the embodiment, the measured total weight SNA of the ink cartridge 10 is stored in the IC chip 17 in the manufacturing process and when the ink cartridge 10 is installed in the printer 20, the initial value Sc for calculating the remaining amount is calculated. Thus, the processing in the manufacturing process can be simplified.

(9) In the embodiment, the number of times ink injection is possible is stored in the IC chip 17 as the printable amount SA. Since the ink cartridge 10 is installed in the printer 20 for ejecting the same ejection amount of ink, the number of times ink injection is possible is stored as the printable amount SA, so that the ink remaining amount S can be calculated easily.

(10) In the embodiment, the amount of ink unused and remaining in the ink cartridge 10, namely, the amount of ink that cannot completely be consumed theoretically or empirically because of the structure of the ink cartridge 10 is contained in the unavailable amount UA to calculate the printable amount SA. Therefore, the printable amount SA of ink that can be used actually can be found more precisely and ink in the ink bag 11 can be consumed with little waste.

Third Embodiment

Figure 12:
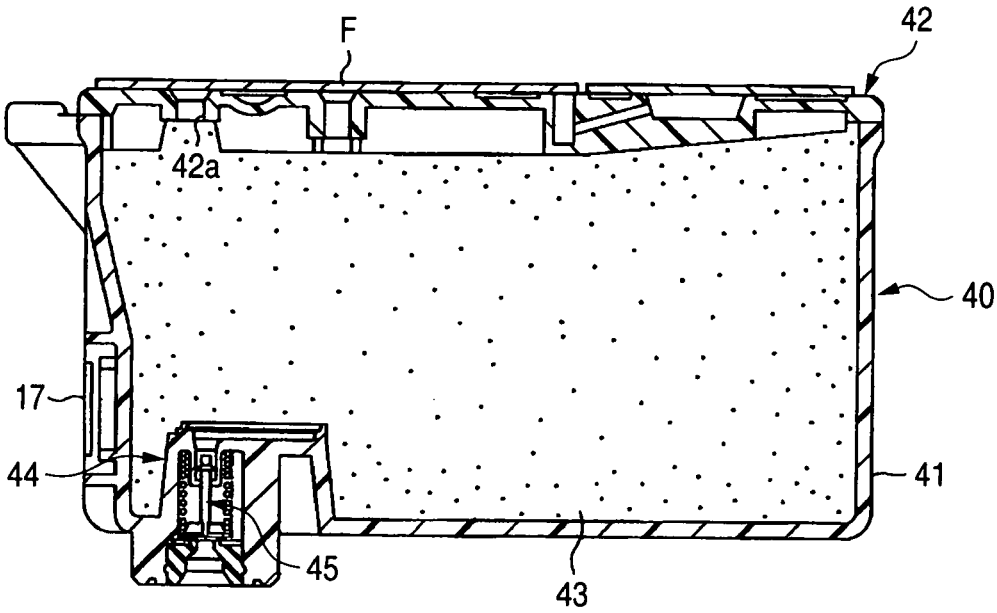
FIG. 12 is a sectional view of an ink cartridge in a third embodiment of the invention.
Figure 13:
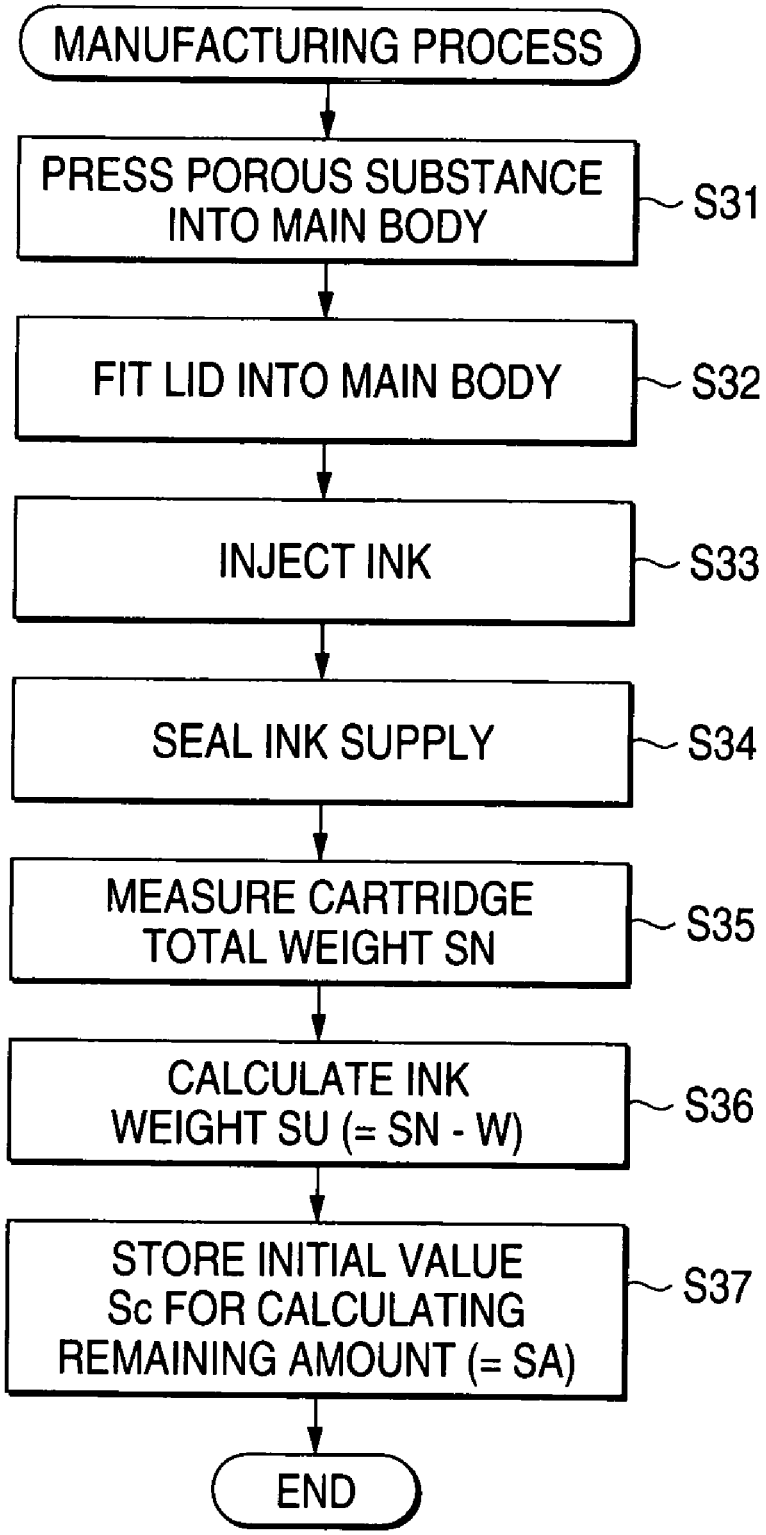
FIG. 13 is a flowchart of a manufacturing process of the ink cartridge in the third embodiment of the invention.

Next, a third embodiment of an ink cartridge of the invention will be discussed with reference to FIGS. 12 to 14.

An ink cartridge 40 of the embodiment is shaped roughly like a rectangular parallelepiped as a whole and is made up of a cup-like main body 41 and a lid 42 for covering the top of the main body.

The main body 41 stores an ink-impregnated porous substance 43. An ink supply section 44 is projected on the lower face of the main body 41 and a well-known valve structure 45 is housed in the ink supply section 44. An IC chip 17 is placed in one side part of the main body 41. On the other hand, the lid 42 is formed with an ink supply hole 42*a* and a seal film F is put on the top of the ink supply hole 42*a*.

Next, a manufacturing method of the ink cartridge 40 will be discussed with reference to FIG. 13.

To begin with, the porous substance 43 is pressed into and housed in the molded main body 41 (step S31). Next, the top of the main body 41 is covered with the lid 42 and the joint part of the main body 41 and the lid 42 is bonded ultrasonically for placing the main body 41 and the lid 42 in one piece, molding the ink cartridge 40 (step S32). The total vessel weight of the molded ink cartridge 40, namely, member weight W of the total weight of the main body 41, the lid 42, and the porous substance 43 is previously measured.

Next, ink is injected into the main body 41 through the ink supply hole 42*a* of the lid 42 (step S33) and the porous substance 43 is impregnated with the ink. Further, the seal film F is put on the top of the ink supply hole 42*a* for sealing the ink supply hole 42*a* (step S34).

Next, cartridge total amount SN of the ink cartridge 40 is measured with a weighing instrument (not shown) (step S35). A manufacturing management computer (not shown) calculates ink weight SU of ink stored in the main body 41 from the measured cartridge total amount SN (step S36). In detail, the member weight W is subtracted from the cartridge total amount SN of the ink cartridge 40 to find the ink weight SU (=SN-W). The ink weight SU is converted into printable amount SA and the provided printable amount SA is stored in the IC chip 17 as an initial value Sc for calculating a remaining amount (step S37), as in the first embodiment.

Figure 14:
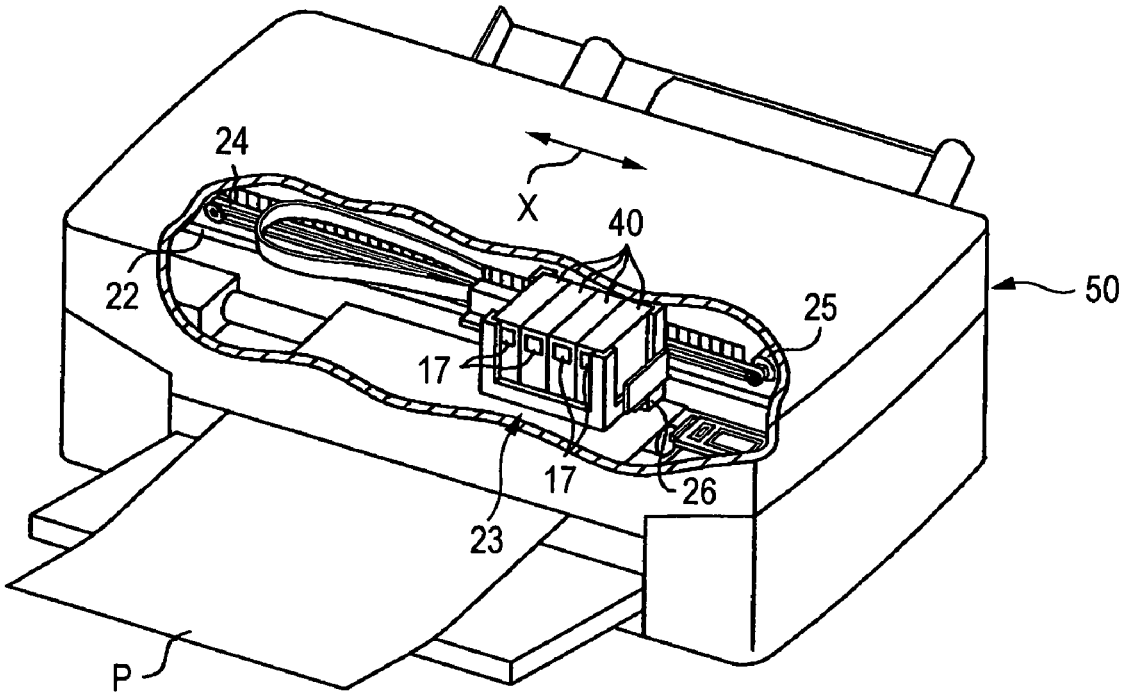
FIG. 14 is a sectional perspective view of the main part of a printer in which the ink cartridge in the third embodiment of the invention is installed.

The ink cartridge 40 thus completed is installed in a printer 50 shown in FIG. 14 for use. That is, unlike the printer 20 in the first embodiment, the printer 50 includes a carriage 23 on which a plurality of ink cartridges 40 are mounted. While the carriage 23 is moved in a main scanning direction X, ink supplied from each ink cartridge 40 to a print head 26 is ejected through nozzles of the print head 26 for printing. To print, the printer 50 performs almost similar print processing to that previously described with reference to FIG. 9 in the first embodiment.

Therefore, in the embodiment, almost similar advantages to those described above in (1) to (3) can be also provided.

(Modifications)

The embodiments may be modified as follows:

In each embodiment described above, to read information from the IC chip 17, the printer 20, 50 reads and writes information from and into the IC chip 17 through the connection terminal (not shown). Instead, the printer 20, 50 may read and write information from and into the IC chip 17, for example, by radio, namely, may be provided with a transmission-reception section and may read and write information from and into the IC chip 17 in a non-contact manner through the transmission-reception section.

In the first embodiment, the cartridge total weight SN of the ink bag 11 is measured. However, as in the second embodiment, the total weight SNA of the ink cartridge 10 may be measured and the initial value Sc for calculating the remaining amount may be calculated from the total weight SNA. In this case, molding of the ink cartridge 10 is already completed and the IC chip 17 is placed at the measuring time and therefore the calculated initial value Sc for calculating the remaining amount can be written into the IC chip immediately. Thus, the possibility that any other initial value Sc for calculating the remaining amount may be stored by mistake can be more decreased and the ink in each ink cartridge 10 can be completely consumed more reliably.

In the first and third embodiments, the printable amount SA is stored in the IC chip 17 of the ink cartridge 10 at the completing time in litter units. Instead, if the printable amount SA may be stored in gram units, the initial value Sc for calculating the remaining amount may be stored in gram units and whenever printing is executed, the ejected ink amount may be converted from little units into gram units for keeping track of the ink remaining amount S. In this case, considering the operating temperature and viscosity, the ink remaining amount S can also be stored in the IC chip 17 more precisely.

In the first and third embodiments, as in the second embodiment, the member weight W may be previously stored in memory of the printer 20, 50, the cartridge total weight SN may be stored in the IC chip 17 of the ink cartridge 10, 40, and when the ink cartridge 10, 40 is installed, the initial value Sc for calculating the remaining amount may be calculated.

In the first and third embodiments, a new ink remaining amount S calculated from the initial value Sc for calculating the remaining amount and the consumption amount SQ at the printing time is stored in the IC chip 17. Instead, only the initial value Sc for calculating the remaining amount may be stored in the IC chip 17. That is, in the printer 20, 50, only the initial value Sc for calculating the remaining amount may be acquired from the IC chip 17 and the new calculated ink remaining amount S may be stored in the printer 20, 50 without being stored in the IC chip 17.

In the second embodiment, the total weight of the ink bag 11 (cartridge total weight SN) may be measured instead of measuring the total weight SNA of the ink cartridge 10 and the cartridge total weight SN may be stored in the IC chip 17. In this case, the total vessel weight contained as the unavailable amount UA is only the weight of the laminated films RF and the ink derivation section 15, so that weight errors of the case 12 and the lid 13 are not contained and the amount of ink in the ink bag 11 can be found more precisely.

In the first embodiment, the ink cartridge is made up of the ink bag 11, the case 12 housing the ink bag 11, and the IC chip 17 attached to the case 12, but the IC chip 17 or a bar code or the like may be attached directly to the case 12 for storing the total weight. In this case, the case housing the ink bag 11 is formed in the printer main unit. Various forms are possible as the ink bag 11 to which the IC chip 17 is directly attached; for example, an ink bag disclosed in US-2002-0051021-A1 can be used preferably.

In the first embodiment, when the ink cartridge is manufactured, the total weight of the ink bag 11 (cartridge total weight SN) is measured and the cartridge total weight SN is stored in the IC chip 17, but this can also be applied when the ink cartridge is again filled with ink after ink in the ink cartridge has been consumed. In this case, ink may remain in the ink bag and therefore the ink is forcibly discharged from the ink derivation section 15 and then the ink bag is weighed before the ink cartridge is filled with ink. After the ink cartridge is filled with a predetermined amount of ink in the filling process, the total weight of the ink bag 11 (cartridge total weight SN) may be measured and the cartridge total weight SN may be stored in the IC chip 17 as in the first embodiment. The invention can be applied to various known ink refilling methods. For example, the invention can be applied to a refilling method disclosed in U.S. Pat. No. 5,950,403.

In the invention, the total weight of the liquid container storing liquid is measured and the initial value for the remaining amount is found based on the measured total weight of the liquid container. Since the liquid remaining amount is calculated from the initial value for the remaining amount, the liquid remaining amount and the actual remaining amount of the liquid in the liquid container more match and the liquid in the liquid container can be almost all consumed. Therefore, the liquid in the liquid container can be used efficiently and effective use of the resources can be made.

What is claimed is:

1. A liquid container for storing a liquid and mountable on a liquid ejection apparatus, comprising:

a memory device that stores a measured total weight of the liquid and in which can be stored a first information concerning the liquid container, the first information being equal to a number of times that the liquid container has been mounted, and a second information concerning a liquid amount;

wherein the total weight is provided to a liquid ejection apparatus when the liquid container is mounted therein, the first information having a predetermined value, and the second information is calculated based on the measured total weight by the liquid ejection apparatus and is provided to the liquid container.

2. A liquid container according to claim 1, wherein the predetermined value of the first information corresponds to 0.

3. A liquid container according to claim 1, wherein the second information includes an initial value for calculating a remaining amount of the liquid.

4. A liquid container according to claim 3, wherein the second information includes a number of times that liquid ejection from the liquid container is possible.

5. A liquid container according to claim 1, wherein the total weight is measured in an initial state of the liquid container.

6. A liquid container according to claim 1, wherein the liquid ejection apparatus calculates a liquid weight by subtracting an unavailable amount value stored in a memory of the liquid ejection apparatus from the total weight, and converts the liquid weight to the second information.

7. A liquid container according to claim 1, wherein the liquid is filled into a liquid storage bag made of a flexible film and the liquid storage bag is housed in a case.

8. A liquid container according to claim 7, wherein the memory device stores a total weight of the liquid storage bag measured in an initial condition as the measured total weight.

9. A liquid ejection apparatus in which a liquid container is mountable, the liquid container having a first information being equal to a number of times that the liquid container has been mounted, the first information being stored in the liquid container, the liquid ejection apparatus comprising:

a calculation unit for calculating a second information concerning a liquid amount;

wherein the calculation unit acquires a measured total weight stored in the liquid container when the liquid container is mounted in the liquid ejection apparatus in a condition that the first information concerning the liquid container has a predetermined value; and the calculation unit calculates the second information based on the measured total weight and outputs the second information to the liquid container.

10. A liquid ejection apparatus according to claim 9, wherein the predetermined value of the first information corresponds to 0.

11. A liquid ejection apparatus according to claim 9, wherein the second information includes an initial value for calculating a remaining amount of the liquid.

12. A liquid ejection apparatus according to claim 9, wherein the second information includes a number of times that liquid ejection from the liquid container is possible.

13. A liquid ejection apparatus according to claim 9, wherein the calculation unit calculates a liquid weight by subtracting an unavailable amount value which is stored in a memory of the liquid ejection apparatus from the measured total weight, and converts the liquid weight to the second information.

14. A method for calculating a liquid amount of a liquid container mounted in a liquid ejection apparatus, comprising the steps of:

mounting the liquid container to the liquid ejection apparatus;

sending a measured total weight stored in a memory device of the liquid container to the liquid ejection apparatus in a condition that a first information concerning the liquid container has a predetermined value, the first information being equal to a number of times that the liquid container has been mounted, the first information being stored in the liquid container;

calculating a second information concerning the liquid amount based on the measured total weight; and providing the second information to the liquid container.

15. A method for calculating a liquid amount according to claim 14, wherein the predetermined value of the first information corresponds to 0.

16. A method for calculating a liquid amount according to claim 14, wherein the second information includes an initial value for calculating a remaining amount of the liquid.

17. A method for calculating a liquid amount according to claim 14, wherein the second information includes a number of times that liquid ejection from the liquid container is possible.

18. A method for calculating a liquid amount according to claim 14, wherein a liquid weight is calculated by subtracting an unavailable amount value which is stored in a memory of the liquid ejection apparatus from the measured total weight, and the liquid weight is converted to the second information.

* * * * *